United States Patent [19]

Firebaugh

[11] Patent Number: 4,947,437

[45] Date of Patent: Aug. 7, 1990

[54] STEREO MICROPHONE

[76] Inventor: William H. Firebaugh, 655 Baker St., AA111, Costa Mesa, Calif. 92626

[21] Appl. No.: 400,783

[22] Filed: Aug. 30, 1989

[51] Int. Cl.[5] ..... H04R 5/027

[52] U.S. Cl. ..... 381/26; 381/170; 381/172

[58] Field of Search ..... 381/26, 172, 170, 111

[56] References Cited

FOREIGN PATENT DOCUMENTS 0145299 8/1983 Japan ..... 381/172

*Primary Examiner*—Forester W. Isen

*Attorney, Agent, or Firm*—Lawrence Fleming

[57] ABSTRACT

A stereo microphone that delivers "Right" and "Left" output signals from the sound field at a single point in space. A small, light, ball-like sound-sensing element is loosely suspended so that it is free to move in any direction in a plane. Directional components of its displacements are sensed and translated into electrical analog signals, which are then processed to provide separate stereo outputs. The sound-sensing element may be suspended on an optical fiber and its displacements sensed by a quad photodetector, whose four outputs are added and subtracted in certain combinations to derive the stereo outputs.

11 Claims, 2 Drawing Sheets

FIG. 1.
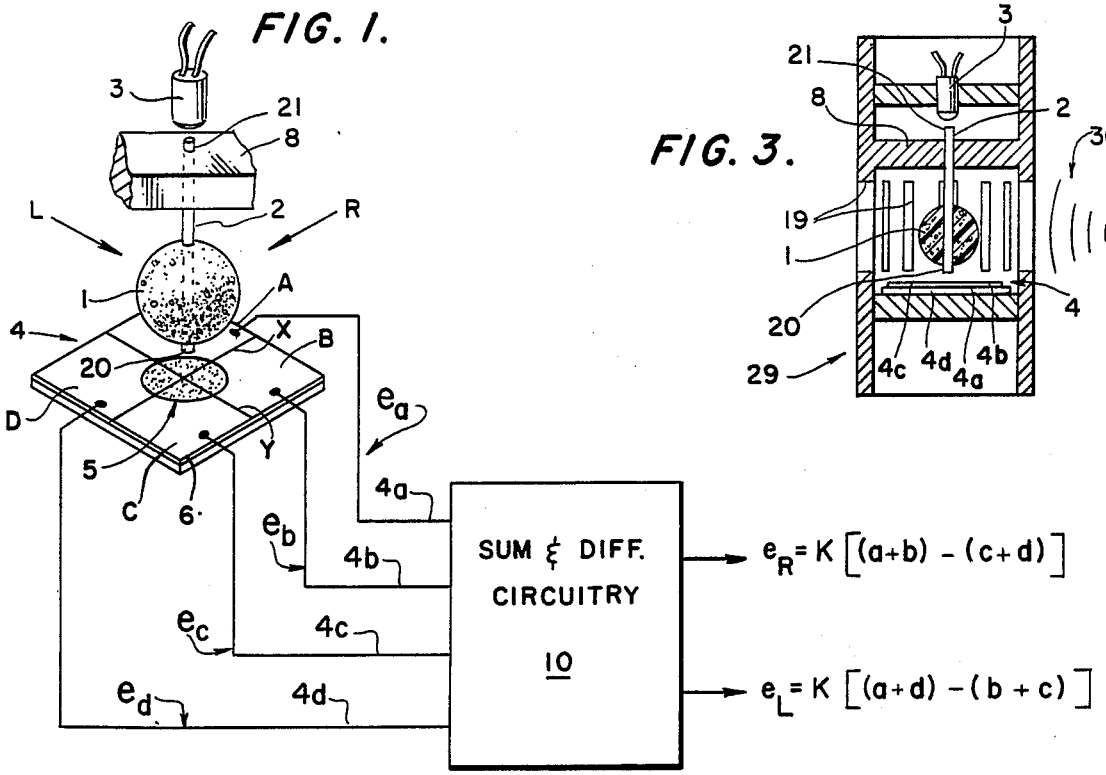
FIG. 3.
FIG. 7.
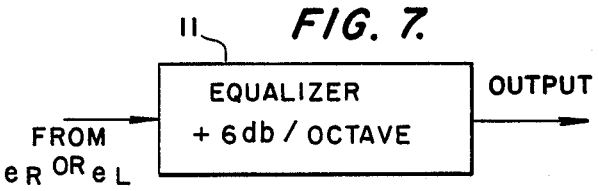
FIG. 2.
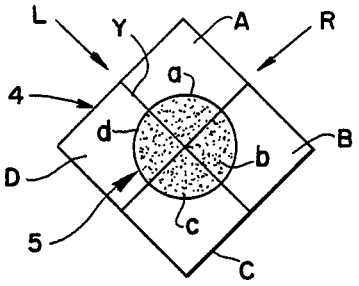
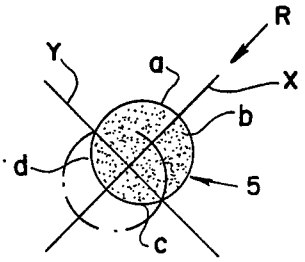
FIG. 4.
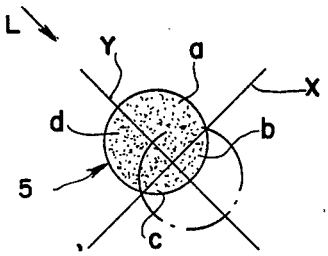
FIG. 5.
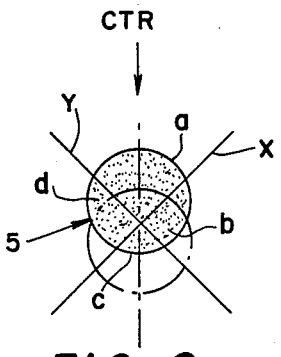
FIG. 6.

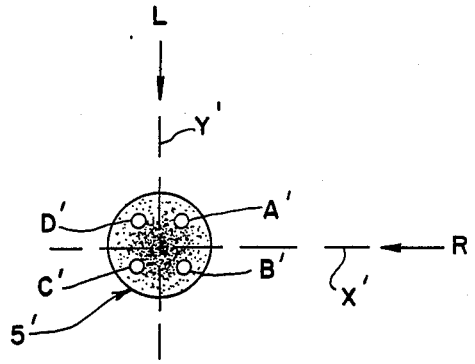
FIG. 9.
FIG. 8.
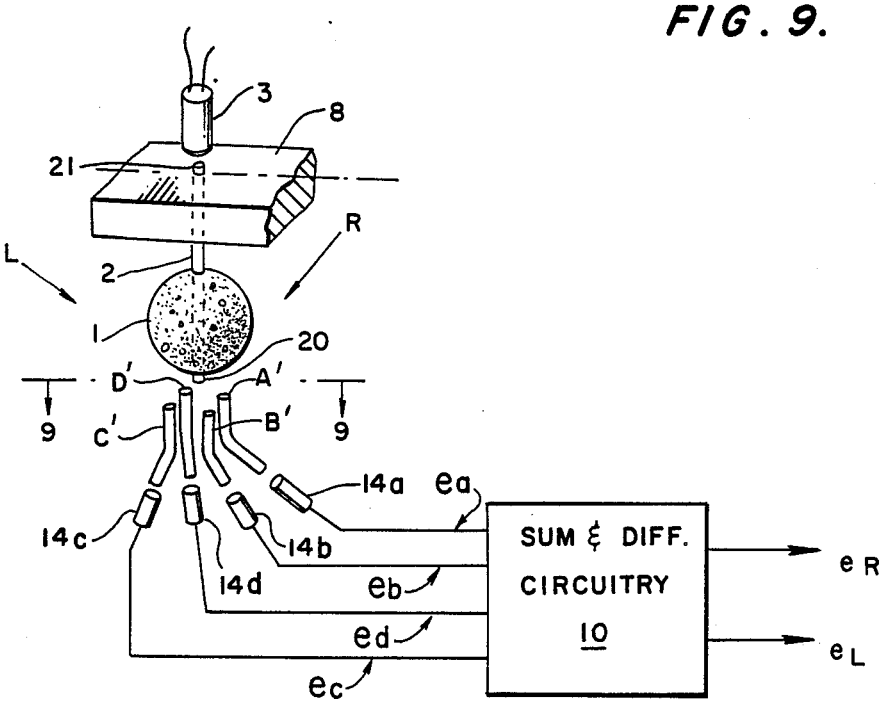
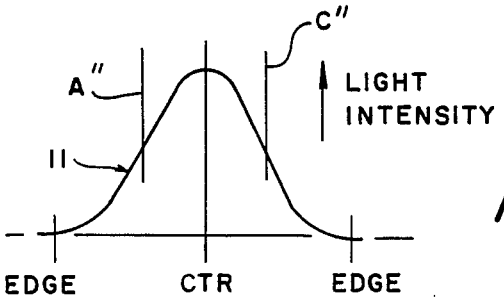
FIG. 10.

STEREO MICROPHONE

FIELD OF THE INVENTION

This invention relates to microphones such as are used in sound recording and, more particularly, to microphones for stereophonic recording. The invention employs a single sensing element responsive to incident sound waves, with translating and signal processing means to distinguish between waves coming from one direction and waves coming from another direction generally orthogonal to it. These means act to produce two separate electrical output signals, "Right" and "Left". Part of these means are preferably photoelectric.

BACKGROUND ART

I am not aware of any prior art wherein a single sound-responsive element is combined with means to derive separate stereophonic "Right" and "Left" output signals from its displacements. A preliminary search has found the following U.S. patents:

(a) 2,173,994 Anderson
(b) 3,534,181 Zimmerman
(c) 3,666,896 Laue
(d) 4,422,182 Kenjyo
(e) 4,479,265 Muscatell.

Of this art, (a), (d), and (e) show monophonic microphones which employ optical sensing of the displacement of a diaphragm or the like. Items (b) and (c) show phonograph pickups which employ optical sensing of the displacements of the stylus.

The Anderson patent (a) of 1939 shows broadly a monophonic microphone using a mirror rocked angularly through a small arc by a linkage to a diaphragm, with photoelectric translating means. Kenjyo (d) shows a monophonic microphone wherein diaphragm displacement displaces a line or slit of light along a sensitive digital element. Muscatell (e) shows microphones having a loosely-suspended, low-mass, light-reflecting ball, e.g., 46 in FIGS. 7 and 8, responsive to sound waves; translation is by Doppler interferometry and is not stereophonic. Zimmerman (b) shows a stereo phonograph pickup with mirror 19 moved back and forth in its own plane by stylus 17. Translation into analog electrical signals is via the mirror and photosensors 6, 8. Laue (c) shows a stereophonic phonograph pickup with photoelectric translation. The stylus moves a "light screen" 55, his FIG. 5.

BRIEF DESCRIPTION

A ball-like sound-responsive or sensing element is loosely suspended so as to move vibrationally in any direction in a generally horizontal plane, the direction of its motion being determined by the direction from which sound waves come in that plane. A preferred kind of suspension is a single fiber on which the ball-like sensing element hangs, as on a thin cantilever spring. The ball may be of plastic foam.

The suspension fiber is preferably an optical fiber, fixed at one end, normally its upper end, and passing through the sensing element. A light source illuminates the fixed end of the fiber. The ball or lower end of the fiber is exposed so that the light passing through the fiber exits at or near the far side, or lower portion, of the ball-like element.

Light exiting from the far or lower end of the optical suspension fiber projects a spot of light onto a plane (here called a light-sensing plane) below and perpendicular to it. In a preferred form of the invention, the flat surface of a quadrant photodetector occupies this plane. A portion of the light spot falls in each of the four quadrants. Each quadrant delivers an electrical output signal as a function of the portion of its area that the spot illuminates. Orthogonal dividing lines separate the quadrants.

It can be shown that these four electrical signals can be combined in a way to produce two separate stereophonic output signals. When sound waves make the ball-like sensing element vibrate along the direction of one dividing line, a "RIGHT" signal can be derived; along the orthogonal direction, a "LEFT" signal.

These stereo output signals are analogs of the directional components of the incident sound wave at a single point in space—the sensing element. Prior stereo apparatus using two or more microphones delivers "R" and "L" signals from separated points in space.

In the present invention, the "R" and "L" signals are derived by taking sums and differences of combinations of the signals from the four photodetectors.

In another form of the invention, four discrete photodetectors, such as phototransistors, are disposed in the light-sensing plane. In this form of the invention, the above quadrants and the orthogonal lines that divide them are imaginary, but are spoken of here to clarify the description. One of the discrete photodetectors is positioned in each quadrant, about equidistant from the center—which is the intersection of the dividing lines and approximately the center of the light spot coming from the suspension fiber.

In this form, the intensity of the light in the light spot is non-uniform from center to edge. Hence, when the spot is displaced, a photodetector will experience a change in illumination because it is occupying a different part of the spot.

Instead of locating the detectors in the sensing plane, the ends of optical fibers or light conductors may be positioned in that plane, and conduct the light to photodetectors disposed in a more convenient location.

IN THE DRAWING

FIG. 1 is a semi-diagrammatic perspective view of a stereomicrophone according to the invention, with the signal processing circuitry in block form;

FIG. 2 is a view looking down on the surface of a quad photodetector;

FIG. 3 is a simplified side cross sectional view of a stereomicrophone according to the invention;

FIGS. 4–6 are explanatory diagrams showing different positions of a light spot on a quad photodetector;

FIG. 7 is an explanatory block diagram;

FIG. 8 is a semi-diagrammatic perspective view of a modification of the embodiment of FIG. 1;

FIG. 9 is a sectional view in direction 9—9 of FIG. 8; and

FIG. 10 is an explanatory graph relating to FIGS. 8 and 9.

DETAILED DESCRIPTION

In the general view of FIG. 1, a sound-responsive element 1 of generally ball-like shape is suspended on an optical fiber 2 which runs clear through it. The upper or fixed end portion 21 of fiber 2 is fixed in a suitable stationary frame member indicated at 8. A small light source 3 illuminates the fixed end 21. Below and spaced from sound-responsive or sound-sensing element 1 is a photodetector 4, shown here as of the flat quadrant type, and having its surface in a plane on which a spot of light 5 falls. Light spot 5 comes from light exiting the lower or free end 20 of optical suspension fiber 2. Light spot 5 covers a portion, but not all, of each of the four separate planar photodetectors A–D that make up the quad unit 4.

The sound-responsive or sound-sensing element 1 may preferably be made of polystyrene foam or like rigid material of very low density. Obviously, it need not be spherical in shape, but may, for example, be polyhedral or finned. In this specification, the term "ball-like" means any compact unitary shape acting as a substantially rigid body free from self-resonances up to the highest frequency of interest, e.g., 20 KHz for audio applications—as contrasted with such shapes as ribbons and diaphragms. The diameter of sensing element 1 is determined by diffraction considerations and should preferably not exceed about 5 mm.

The natural frequency of the oscillatory system of the mass of element 1 and the stiffness in bending of fiber 2 should lie generally below the frequency range of interest, e.g., 10 or 20 Hz. This systems is mass-controlled, like the ribbon in a ribbon microphone or the cone and suspension of a loud speaker. In practice the resonance at this frequency may be effectively damped by air friction.

FIG. 3 shows a more detailed structure. A suitable frame and housing 29 has a cross-member 8 in which the upper end portion 21 of optical fiber 2 is secured. Lamp 3 is mounted above it, as in FIG. 1. Sound waves, indicated at 30, pass through openings 19 to reach sensing element 1. Photodetector 4 is mounted below ball-like element 1 and the lower end 20 of fiber 2. An optical filter 7 may cover detector 4 to reduce effects of ambient light; lamp 3 may, e.g., emit infrared and the filter 7 pass infrared and filter out visible light.

Referring again to FIGS. 1 and 2, FIG. 2 shows more clearly the spot of light 5 from fiber end 20 which falls on the surface of quad photodetector 4. The four adjacent detectors that make it up are designated A, B, C. D. The orthogonal lines of division between them are indicated as X, Y. The portion of each detector A . . . D that is illuminated by a portion of light spot 5 is called correspondingly a . . . d. In FIG. 2, it will be seen that if light spot 5 is displaced in the direction of arrow L, portions or areas a and d will decrease in area, and portions b and c will increase in area.

These relationships are explained further in connection with FIGS. 4–6. In FIG. 4, spot 5 is indicated as moving along direction R between the hatched position and the dotted position. It will be seen that the difference between the area sums (a+b) and (c+d) varies. However, the difference between (b+c) and (a+d) stays the same.

In FIG. 5, in similar fashion, illuminated spot 5 is indicated as displaced along the direction of arrow L, representing an effect of sound coming from that direction. Have, the difference between area sums (a+d) and (b+c) varies, but the difference between (a+b) and (c+d) is unchanged.

FIG. 6 indicates the effect of displacing spot 5 along a central line CTR halfway between R and L. Spot areas b and d remain unchanged; the only change is in the difference (a−c).

Returning to FIG. 1, the outputs of the four cells A, B, C, D that make up quad photodetector 4 are fed via suitable signal paths 4a, 4b, 4c, 4d to sum and difference circuitry of any suitable known design indicated by block 10. The outputs of block 10 are two separate stereo electrical "Right" and "Left" signals $e_R$ and $e_L$, whose composition is given in FIG. 1. "Right" signal $e_R$ is constant K times the difference between spot 5 areas (a+b) and (c+d). "Left" signal $e_L$ is the same constant K times the difference between spot areas (a+d) and (b+c). The constant K is a function of the sensitivity of the photodetectors in the areas a, b, c, d; the intensity of the illumination; and the signal gains or losses in block 10. It may be noted that the algebraic sum of $e_R$ and $e_L$ is 2K(a−c). It is also noted that the "Right" direction is substantially that of line X, and the "Left" that of line Y.

In the above discussion, it is assumed that the electrical signals in the signal paths 4a . . . 4d are generally proportional to the spot areas a . . . d. For quad detector 4, this assumption is correct. For simplicity, in accordance with this assumption, the algebraic expressions in FIG. 1 for the stereo outputs $e_R$ and $e_L$ are given in terms of the areas a . . . d, instead of the signals $e_a$ . . . $e_d$. In the modification of FIG. 8, however, this assumption does not apply, so the stereo outputs of the sum and difference circuitry are given in this specification in terms of the signal inputs $e_a$ . . . $e_d$. The circuitry 10 itself may obviously be the same for both the FIG. 1 and the FIG. 8 forms of the invention.

FIG. 7 indicates a frequency response equalizer of any suitable known type, in block form. Output "Left" and "Right" signals $e_L$ and $e_R$ are proportional to the displacement of light spot 5 or 5' (e.g., FIGS. 2 and 9), rather than the velocity with which it is moving. Hence, in a constant-pressure sound field, the response at the outputs of block 10, FIGS. 1 and 8, will be inversely proportional to frequency. Thus, a suitable equalizer 11 may be inserted in each of the output lines of block 10.

Referring now to the form of the invention of FIG. 8, the structure may be the same as that of FIGS. 1 and 3, except that the flat quad photodetector 4 is replaced by an array of four discrete light-sensing elements disposed generally as at the corners of a square whose center lies below the exiting or free end of optical fiber 2 on which ball-like sensing element 1 is suspended, and the light spot is non-uniform. These discrete photosensors may preferably take the form of optical fibers or "light pipes" A', B', C', D', which conduct light to individual phototransistors or the like 14a, 14b, 14c, 14d. The light-receiving ends of fibers A' . . . D' lie in a light-sensing plane (corresponding to the plane of the surface of quad unit 4 of FIG. 1) on which the light from end 20 of fiber 2, FIG. 8, casts a spot of light. Such a spot is shown in FIG. 9.

The sectional view of FIG. 9 shows the relation of the ends of the fibers or receptors A' . . . D' in the light-sensing plane to the spot of light 5' that falls on them. It is apparent that displacement of spot 5' will not change the relative illumination of receptors A'–D', if it is of uniform intensity over all its area. But if the intensity in spot 5' varies radially from center to edge, as indicated, the illumination at a light-sensing point may change with the position of the spot 5'. In FIGS. 8 and 9, the spot is made non-uniform in brightness in that manner. Such non-uniformity may be effected by any suitable known optical means.

FIG. 10 shows a suitable form of a curve 11 of light intensity vs. distance from edge of spot 5'. It is assumed that this curve is about the same across all diameters of the light spot 5'. It is apparent that the light receptors A' . . . D' should best be located at distances from the center (CTR, FIG. 10) where the slope of curve 11 is the steepest and most uniform, as at A'', C'' in FIG. 10.

Imaginary lines X', Y' are shown in FIG. 9 as dividing the area of light spot 5' into quadrants, corresponding to the real division lines X, Y in FIG. 1. In FIG. 9, the "R" direction is that of line X', similarly to the "R" direction being that of line X of FIGS. 1 and 2; similarly with the "L" directions corresponding to lines Y' and Y.

The electrical signals $e_a$ . . . $e_d$ in FIG. 10 are processed by circuitry 10 in the same way as in FIG. 1.

It is apparent that in FIG. 8, sensors such as 14*a* . . . 14*d* may be disposed directly in the light-sensing plane if there is room for them, instead of using light pipes or fibers such as A' . . . D'.

Other known means of translating the displacements of sound-sensing element 1 into an electrical signal may be employed, such as capacitive or magnetic. The light spot may be shaped and directed, as desired, by lenses or mirrors in known manner.

I claim:

1. A microphone comprising a ball-like sound-responsive element;

a suspension attached to said element and constraining it to displacement generally in a plane, sound waves from an "R" direction in said plane displacing said element therealong in an R'' displacement, and waves from an "L" direction about orthogonal to said "R" direction displacing it therealong in an "L" displacement;

translating means to sense said displacements and providing signals containing information distinguishing between displacements in said "R" and "L" directions; and signal processing means having input connections to said translating means and output connections delivering two separate output signals analogous respectively to said "R" and "L" displacements.

2. A microphone as in claim 1 wherein said element is of low-density plastic foam, and said suspension is a fiber connecting said element to a fixed frame member in cantilever fashion, said fiber and element forming a mass-spring system with a natural frequency generally below the frequency range to be sensed.

3. A microphone as in claim 2 wherein said translating means are photoelectric.

4. A microphone as in claim 3 wherein said fiber is a light-conducting optical fiber, and further comprising a light source disposed to illuminate the fixed end of said fiber, said fiber passing through said element to its far end, light exiting from said fiber at said far end, said translating means being disposed to receive said exiting light.

5. A microphone as in claim 4 wherein said translating means comprises four photodetectors, said exiting light casting a spot of light with a portion thereof illuminating each said photodetector.

6. A stereophonic microphone comprising a small ball-like, sound-responsive element of low-density material and adapted to be vibrationally displaced by sound waves;

an optical fiber fixed at an upper end and passing through said element and having a lower end, said fiber providing a compliant cantilever suspension for said element and permitting displacement thereof in a plane perpendicular to said fiber;

a light source illuminating said upper end, light therefrom exiting from said lower end to form a light spot;

a set of four photoelectric sensors disposed to be each illuminated by a portion of said spot; and electrical signal paths from each of said sensors to a set of signal processing circuitry, and two output paths from said circuitry, said circuitry taking sums and differences of the outputs of different pairs of said sensor, one of said output paths delivering a signal analogous to displacements of said element in a predetermined "R" direction, and the other said path delivering a signal analogous to displacements of said element in an "L" direction at about right angles to said "R" direction.

7. A stereophonic microphone as in claim 6 wherein said photoelectric sensors are in the form of a planar quad photodetector.

8. A stereo microphone as in claim 6 wherein said light spot varies substantially in intensity along any radius between its center and its peripheral portion.

9. A stereophonic microphone comprising a small, rigid, low-mass, sound-sensing element;

an optical fiber fixed at a fixed end and attached to and passing through said sensing element with a free end exposed;

a light source illuminating said fixed end, light therefrom emerging from said free end and casting a spot of light onto a light-sensing plane, said plane being divided into four quadrant areas by orthogonal axis lines X, Y having an intersection at about the center of said spot, a portion of said spot falling on each said area;

photodetecting means in each said area providing photoelectric output signals; and electrical signal processing means to effect the following relationships:

$$e_R = K[(e_a + e_b) - (e_c + e_d)],$$

and $$e_L = K[(e_a + e_d) - (e_b + e_c)],$$

where $e_R$ is a stereo output signal analogous to sound velocity along the direction of said line X, $e_L$ is a stereo output signal analogous to sound velocity along the direction of line Y; a, b, c, d are said quadrant areas designated serially in rotation about said intersection, and $e_a$, $e_b$, $e_c$, $e_d$ are said photoelectric output signals from said areas, respectively.

10. A microphone as in claim 9 wherein said photodetecting means comprises a planar quad photodetector.

11. A microphone as in claim 9 wherein said photodetecting means comprises four discrete photodetectors, and said spot of light is substantially non-uniform in intensity along any radius from its center to its periphery.

* * * * *